US005988681A

United States Patent [19]

Vesalainen et al.

[11] Patent Number: 5,988,681

[45] Date of Patent: Nov. 23, 1999

[54] SYSTEM FOR SECURING A SKI POLE TO THE HAND OF A SKIER

[75] Inventors: Mika Vesalainen, Karhula; Taisto Manninen, Mäntyharju, both of Finland

[73] Assignee: Exel Oy, Finland

[21] Appl. No.: 08/945,543

[22] PCT Filed: May 6, 1996

[86] PCT No.: PCT/FI96/00252

§ 371 Date: Oct. 29, 1997

§ 102(e) Date: Oct. 29, 1997

[87] PCT Pub. No.: WO96/34665

PCT Pub. Date: Nov. 7, 1996

[30] Foreign Application Priority Data

May 5, 1995 [FI] Finland ..... 952158

[51] Int. Cl.[6] ..... A63C 11/22; A41D 19/00

[52] U.S. Cl. ..... 280/821; 2/160

[58] Field of Search ..... 280/819, 821, 280/822; 2/159, 160, 161.1

[56] References Cited

U.S. PATENT DOCUMENTS

| | | | |
|---|---|---|---|
| 3,218,089 | 11/1965 | Marchand | 280/822 |
| 4,570,887 | 2/1986 | Banister | 248/187.1 |
| 5,110,154 | 5/1992 | Street | 280/822 |
| 5,312,134 | 5/1994 | Goode | 280/822 |
| 5,328,205 | 7/1994 | Bacharach | 280/822 |
| 5,887,282 | 3/1999 | Lenhart | 2/159 |

FOREIGN PATENT DOCUMENTS

| | | | |
|---|---|---|---|
| 0370900 | 5/1990 | European Pat. Off. | 280/822 |
| 169214 | 1/1990 | Norway | 280/822 |

*Primary Examiner*—Christopher P. Ellis
*Assistant Examiner*—Andrew J. Ririe
*Attorney, Agent, or Firm*—Rothwell, Figg, Ernst & Kurz, P.C.

[57] ABSTRACT

A system for securing a ski pole to a hand of a skier, wherein a ski glove or a hand-wrapping harness strap includes a wedge-shaped or triangular locking piece, with the locking piece being attached to the harness strap or attached to the ski glove by a flexible lip located within a web area between a thumb and an index finger of the glove, the locking piece being releasably claspable to a handgrip of the ski pole, with the handgrip being provided with a mating-shaped cavity for receiving the locking piece with a fit reminiscent of a dove-tail joint.

7 Claims, 3 Drawing Sheets

SYSTEM FOR SECURING A SKI POLE TO THE HAND OF A SKIER

BACKGROUND OF THE INVENTION

1. Field of the Invention

The present invention relates to a system for securing a ski pole to the hand of a skier. The invention also relates to a ski pole which is adapted and intended for use in a system of the invention.

2. Description of the Background Art

In cross-country ski poles, the attachment between the hand and a handgrip is established by means of one or more loop-type straps wrapped around the hand. It has also been proposed that the ski glove be secured to a handgrip by means of straps fitted inside the glove (patent application FI-893528). This requires a specially designed glove, in addition to which the attachment between the glove and the handgrip is structurally inconvenient and difficult to release.

SUMMARY OF THE INVENTION

An object of the invention is to provide an improved assembly including a ski glove or a hand-wrapping harness strap and a ski pole, wherein the locking between the hand-wrapping harness strap or the glove and the handgrip is readily claspable and releasable and which provides a good grip and control of the ski pole even when the finger-hold of the handgrip is released. In cross-country skiing, this situation occurs at the end of a thrust when the hand is in a backward position and the forward motion of a ski pole is about to commence.

This object is achieved by means of a system set forth in the annexed claim 1. The characterizing features for an appropriate ski glove or a hand-wrapping harness strap are set forth in claim 6 and the characterizing features for a ski pole in claim 7. The non-independent claims disclose preferred embodiments for the invention.

BRIEF DESCRIPTION OF THE DRAWINGS

The invention will now be described by way of an exemplary embodiment with reference made to the accompanying drawings, in which.

DETAILED DESCRIPTION OF THE INVENTION

Figure 1:
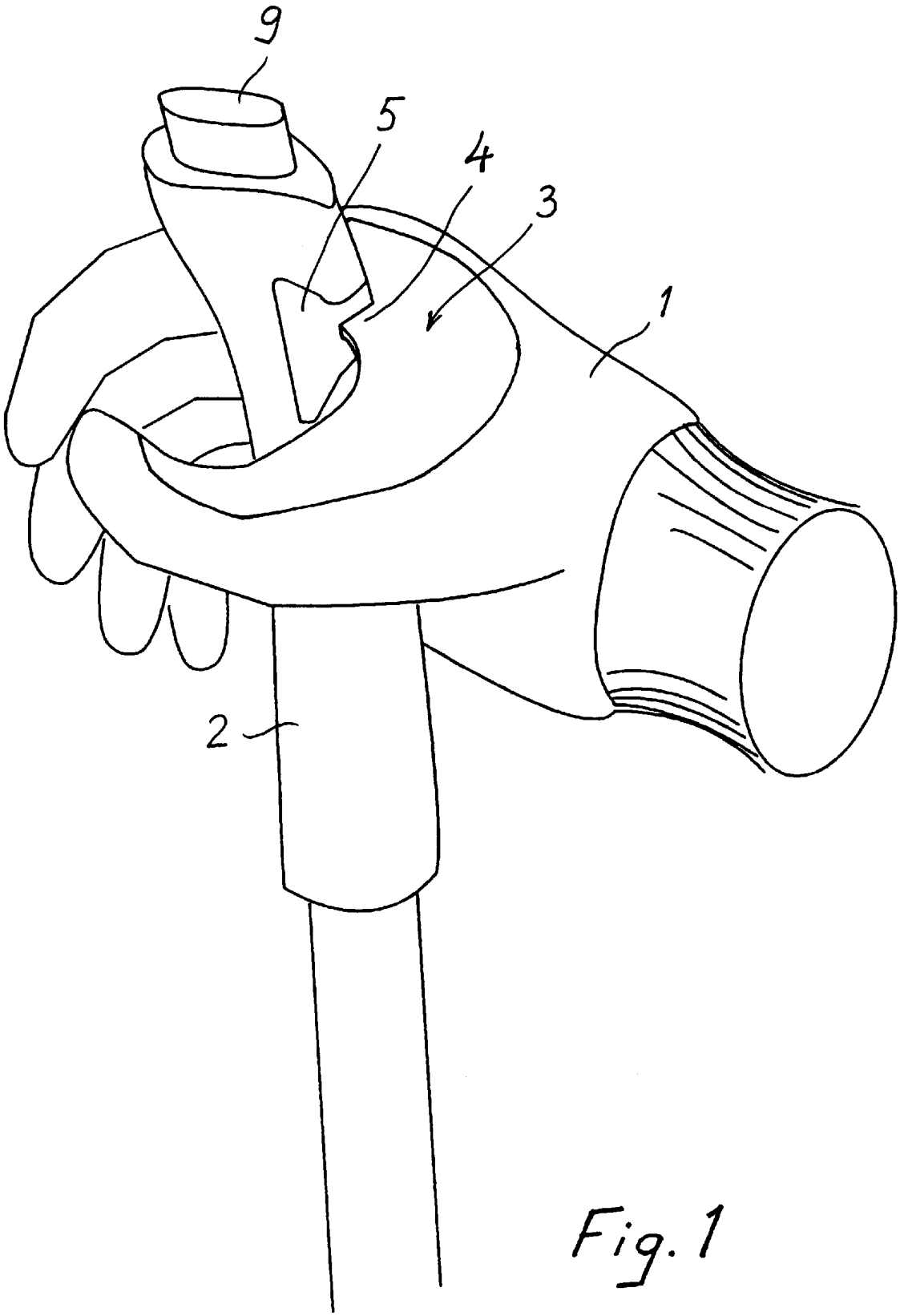
FIG. 1 shows a system of the invention applied to a ski glove in a perspective view.

Reference is first made to the embodiment of FIG. 1.

Figure 2:
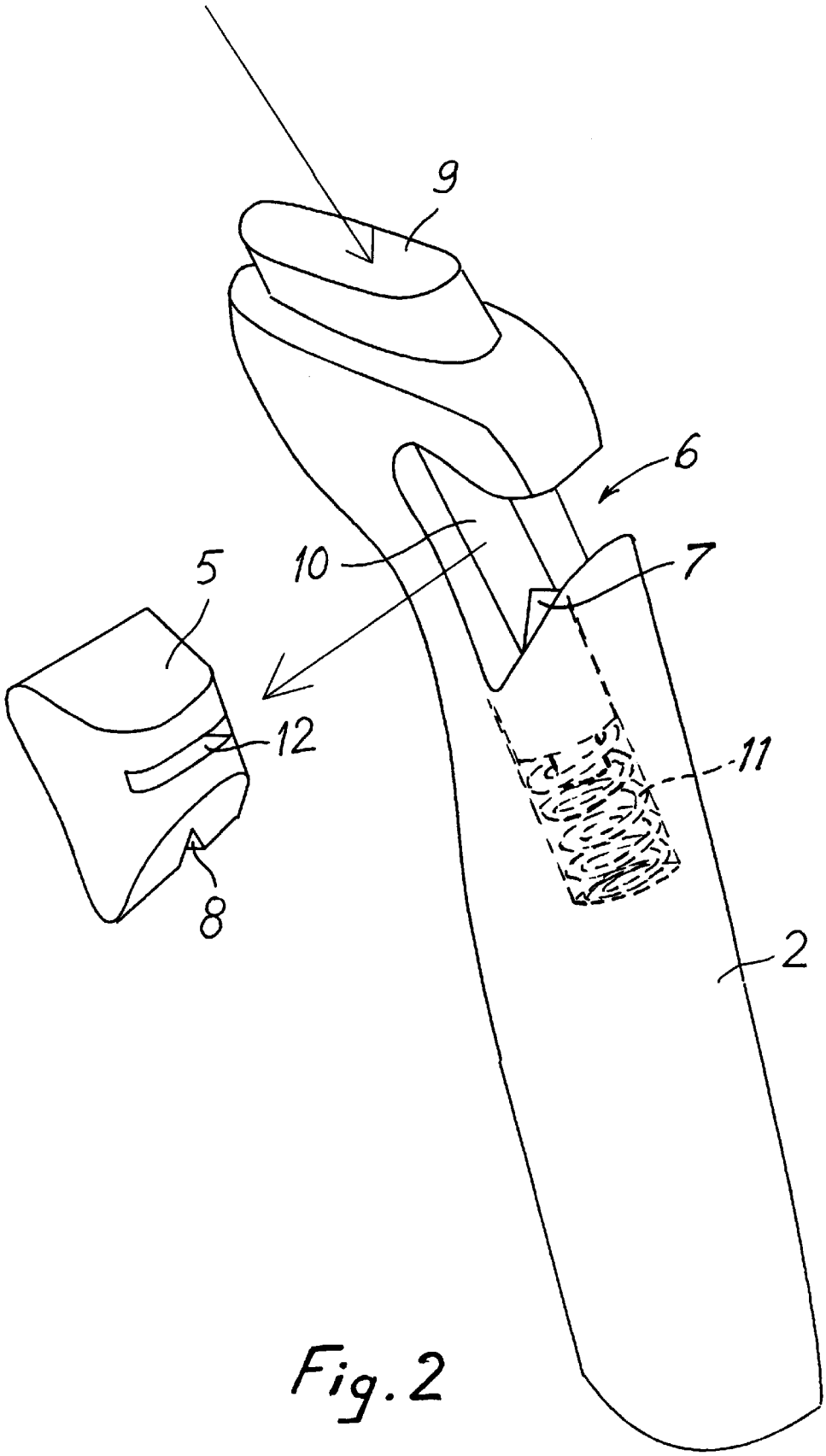
FIG. 2 shows a ski-pole handgrip included in the system with a locking piece disengaged from its position.

In a web area between the thumb and the index finger, a ski glove 1 is provided with a bracing 3 which is made of an inextensible, tough and break-proof, yet elastic material, such as e.g. polyurethane. The bracing 3 is provided with a lip 4 which is secured as an inlay to an extruded or injection-moulded locking piece 5. The locking piece 5 takes the shape of a wedge or a triangle and can be inserted sideways into a receiving cavity 6, included in a handgrip 2 and having a shape matching that of the locking piece 5, as shown in FIG. 2.

The handgrip 2 is provided with a locking bolt 7, 9, 10, including a press-button element 9 extending from the top of the handgrip and a latching pawl 7 engaging in a recess 8 made in the locking piece 5. The locking bolt can be pressed lengthwise of the handgrip against the force of a spring 11 for releasing the latching pawl 7 from the recess 8 of the locking piece 5. Thus, when the bolt 7, 9, 10 is in a depressed position, the locking piece 5 can be pushed into its position in the cavity 6 or disengaged from the cavity 6.

Designated in the locking piece 5 with reference numeral 12 is an attachment point for the lip 4, wherein the lip 4 is permanently secured. Thus, the locking piece 5 is an integral part of the ski glove 1. The user is free to choose fitting-size ski gloves and proper-length poles. The locking piece 5 does not prevent the ski gloves from being used also in applications other than a combination of the invention.

The lip 4 is as short as possible, virtually without a length dimension, the handgrip 2 coming into contact with the web between the thumb and the index finger. Stiffness of the lip 4 can be used to have an effect on how easily the pole is able to swing as the hand releases its grip during the backward movement. A relatively soft and thick bracing 3 protects the hand from sores and also prevents the glove from wearing out. Naturally, the entire palm side of a ski glove can be made of the same polyurethane material as the bracing 3. Of course, the bracing 3 and the lip 4 can also be made of some other material which is tough, break-proof and elastic. For example, leather can be used but, being an extensible material, it is not as preferred as polyurethane, which further provides a possibility of controllably selecting the ratio of hardness and elasticity as well as stiffness of the lip 4. Naturally, it is also possible to use artificial leathers made of materials other than polyurethane and synthetic rubbers are also possible.

The lip 4 is preferably located about 20 mm downwards from the web between the thumb and the index finger, i.e. on top of the upper portion of the palm. The locking piece 5 is located such that the lip 4 is set about 4–6 cm downwards from the top end of a pole.

Figure 3:
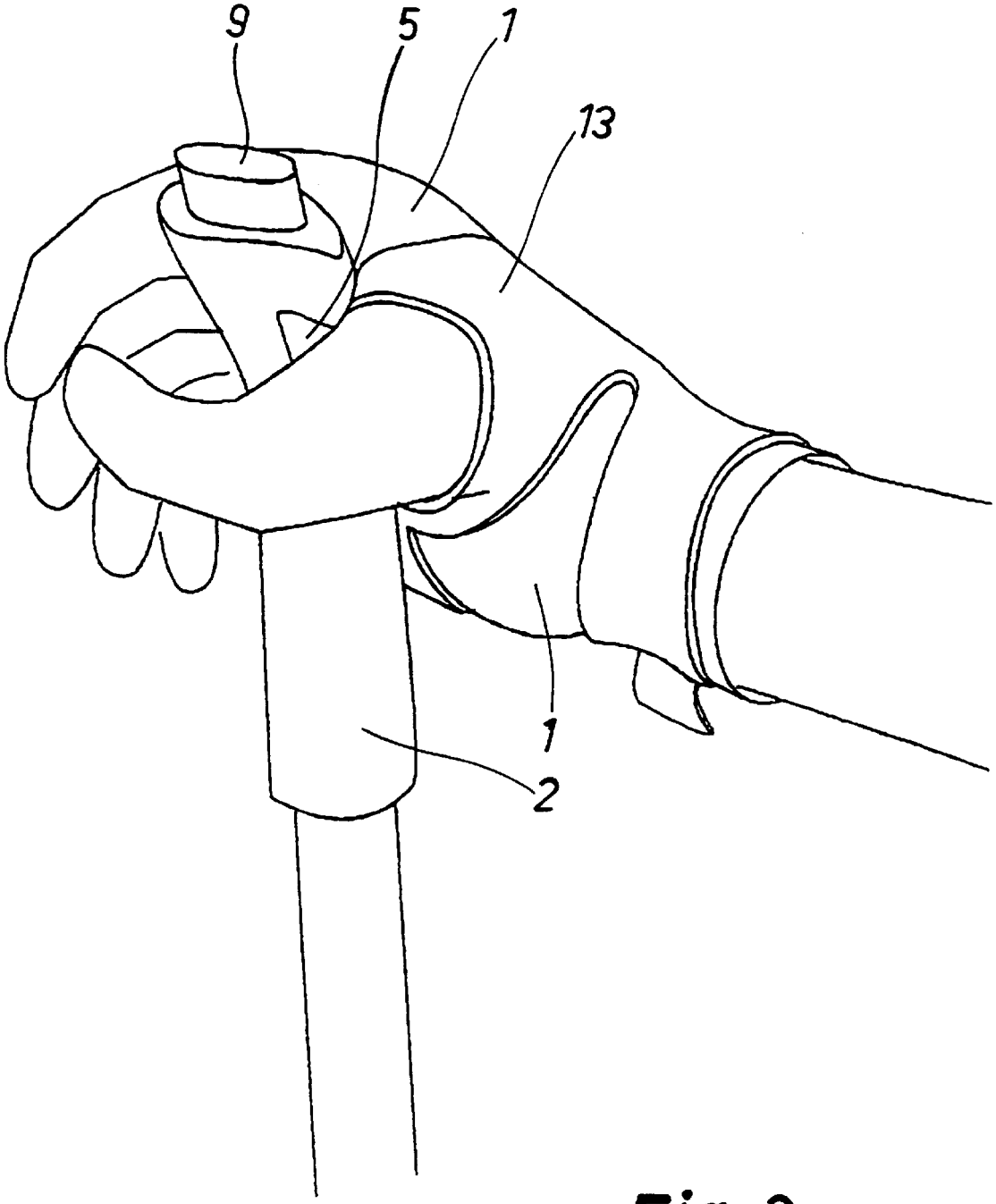
FIG. 3 shows a system according to a second embodiment of the invention applied to a hand-wrapping harness strap.

The exemplary embodiment shown in FIG. 3 differs from the case of FIG. 1 in that the attachment lip 4 is not secured to the actual ski glove 1 but to a hand-wrapping harness strap 13, which can be set on top of a ski glove separately from the glove or make up a part of the ski glove. The harness strap 13 includes a strap section extending around the thumb, a strap section extending around the lower edge of the palm, and a strap section extending around the wrist. The strap section extending around the wrist is provided with a releasable and sealable joint or splice. These strap sections are connected to a section provided on the back of the palm for integrating the harness strap 13 into an integral unit giving a good support for the hand. Also in the case of FIG. 3, the handgrip 2 has a design which corresponds to the above-described design shown in FIG. 2. Thus, the lip 4 is located about 2 cm downwards from the web between the thumb and the index finger and at the same time 4–6 cm downwards from the top end of a pole. Hence, the handgrip is easily retained under control of the hand even during the backward movement of a pole when the handgrip is released from the hold of the hand.

We claim:

1. A system for securing a ski pole to a hand of a skier, wherein a ski glove or a hand-wrapping harness strap includes a wedge-shaped or triangular locking piece, with said locking piece being attached to said harness strap or attached to said ski glove by means of a flexible lip located within a web area between a thumb area and an index finger area of said glove or said harness strap, said locking piece being releasably claspable to a handgrip of said ski pole, with said handgrip being provided with a mating-shaped locking piece cavity for receiving said locking piece with a fit reminiscent of a dove-tail joint, wherein said wedge-shaped or triangular locking piece is insertable sideways into the locking piece cavity, said locking piece cavity being provided with a slot for extending said lip therefrom, and wherein said handgrip is provided with a spring-loaded locking bolt for positively securing said locking piece in said locking piece cavity of said handgrip.

2. A system as set forth in claim 1, wherein said locking bolt extends from said handgrip end and is depressable lengthwise of said handgrip against a force of a spring in such a manner that, once depressed, a bolt latching pawl disengages from a recess included in said locking piece.

3. A system as set forth in claim 1, wherein said web area between said thumb and said index finger is provided with a bracing, said flexible lip being attached to said bracing and being preferably made of a same material as said bracing.

4. A system as set forth in claim 1, wherein in use, said lip is located about 2 cm along a palm of said hand, away from a conjunction of said palm and a thumb, and when said locking piece is received within said cavity, said lip is located about 4–6 cm downwards from a top end of a ski pole.

5. A system as set forth in claim 2, wherein in use, said lip is located about 2 cm along a palm of said hand, away from a conjunction of said palm and a thumb, and when said locking piece is received within said cavity, said lip is located about 4–6 cm downwards from a top end of a ski pole.

6. A system as set forth in claim 3, wherein in use, said lip is located about 2 cm along a palm of said hand, away from a conjunction of said palm and a thumb, and when said locking piece is received within said cavity, said lip is located about 4–6 cm downwards from a top end of a ski pole.

7. A ski pole, comprising a handgrip and a wedge-shaped or triangular locking piece cavity therein for receiving a locking piece included in a ski glove, wherein said locking piece cavity opens at least into one side of said handgrip in such a manner that an apex of said locking piece cavity substantially coincides with a slot included in said locking piece, and that said handgrip is provided with a spring-loaded locking bolt, including a latching pawl which is adapted to engage in a recess included in said locking piece.

* * * * *